United States Patent [19]

Koritan

[11] Patent Number: 5,046,195

[45] Date of Patent: Sep. 10, 1991

[54] HEAD BAND WITH NECK SHIELD

[75] Inventor: Gilbert Koritan, Phoenix, Ariz.

[73] Assignee: Cap-Mate Company, Del.

[21] Appl. No.: 666,566

[22] Filed: Mar. 8, 1991

Related U.S. Application Data

[63] Continuation of Ser. No. 404,548, Sep. 8, 1989, abandoned.

[51] Int. Cl.[5] ..... A41D 1/00; A42B 1/06

[52] U.S. Cl. ..... 2/172; 002/185 R; 002/187; 002/199; 002/DIG. 11

[58] Field of Search ..... 2/185 R, 185 B, 187, 2/195, 196, 199, 209.1, 209.4, DIG. 11, 7, 10, 171, 171.1, 172, 175, 177, 179, 410, 411, 415, 416, 422, 425

[56] References Cited

U.S. PATENT DOCUMENTS

| | | | |
|---|---|---|---|
| 822,986 | 6/1906 | Rochet | 2/187 |
| 889,640 | 6/1908 | Sherman | 2/172 |
| 1,239,910 | 9/1917 | Harris | 2/185 R |
| 1,364,662 | 1/1921 | Wagner | 2/172 |
| 1,690,736 | 11/1928 | Leicht | 2/172 |
| 1,706,205 | 3/1929 | Alonzo | 2/187 |
| 1,909,686 | 5/1933 | Kindall | 2/184.5 |
| 2,055,560 | 9/1936 | Rose | 2/172 |
| 2,192,341 | 3/1940 | Dahlberg | 2/172 |
| 2,767,404 | 10/1956 | Collins | 2/171 |
| 2,844,822 | 7/1958 | Persico et al. | 2/172 |
| 2,897,510 | 8/1959 | Forbes-Robinson | 2/187 |
| 2,986,741 | 6/1961 | Brasington, Jr. | 2/172 |
| 3,166,766 | 1/1965 | Banello, Jr. | 2/187 |
| 4,393,519 | 7/1983 | Nicastro | 2/172 |
| 4,481,681 | 11/1984 | Hankin | 2/183 |
| 4,556,991 | 12/1985 | Margaronis et al. | 2/185 R |
| 4,630,317 | 12/1986 | Brown et al. | 2/DIG. 11 |
| 4,852,189 | 8/1989 | Duggan | 2/DIG. 11 |
| 4,872,218 | 10/1989 | Holt | 2/199 |

FOREIGN PATENT DOCUMENTS

| | | | |
|---|---|---|---|
| 1377550 | 2/1965 | France | 2/199 |

*Primary Examiner*—William A. Cuchlinski, Jr.
*Assistant Examiner*—C. W. Fulton
*Attorney, Agent, or Firm*—Sughrue, Mion, Zinn, Macpeak & Seas

[57] ABSTRACT

An elastic head band is provided with a depending neck shield to protect the wearer's neck from sunburn. The head band may be worn in conjunction with a cap or the neck shield without the head band may be detachably connected to the rear of a cap.

2 Claims, 3 Drawing Sheets

FIG. 1
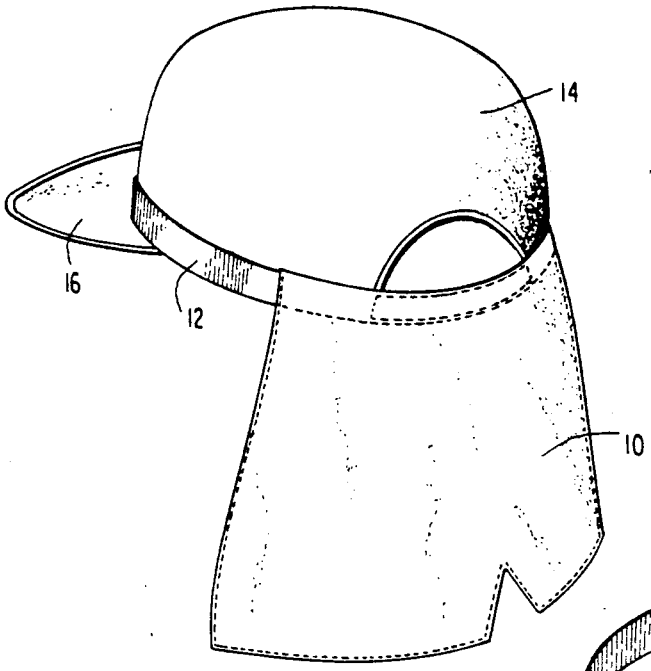
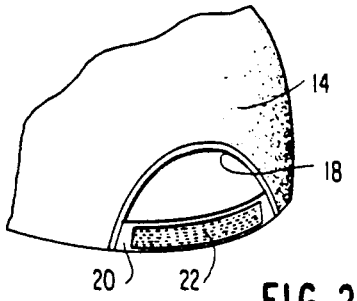
FIG. 2
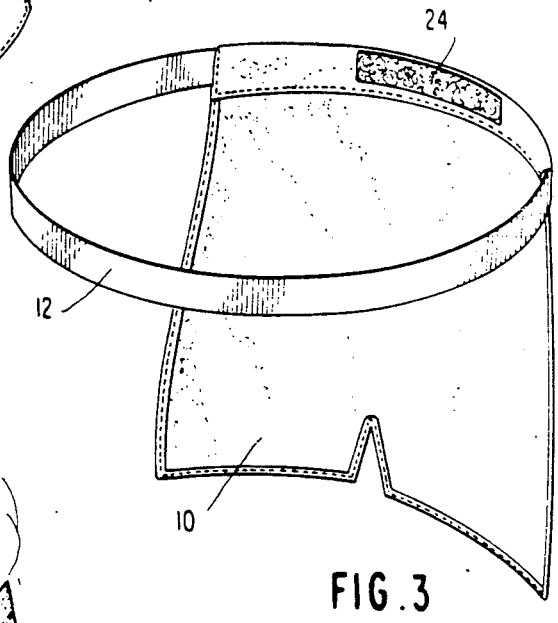
FIG. 3
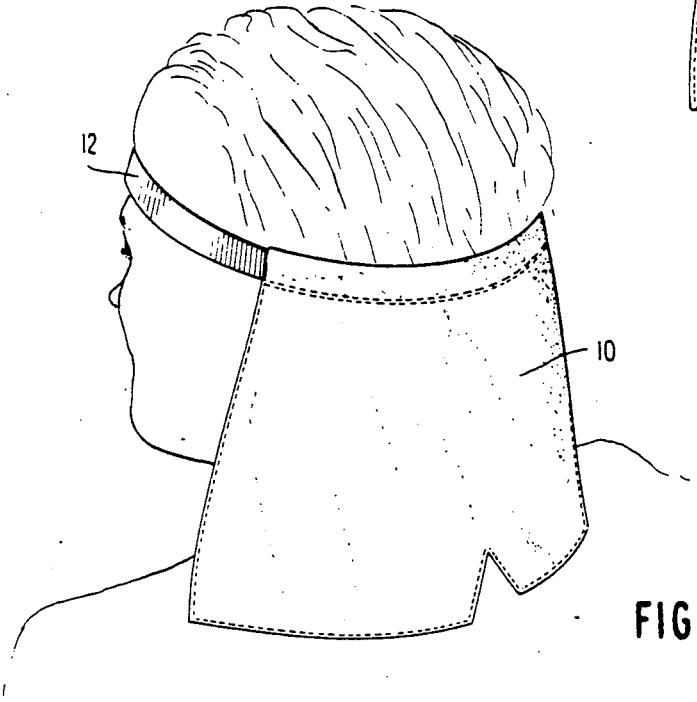
FIG. 4

FIG. 5
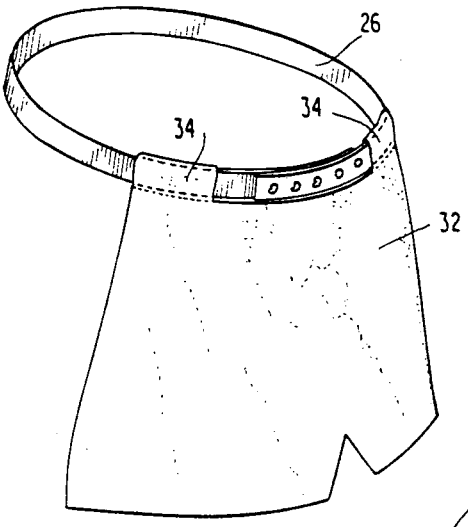
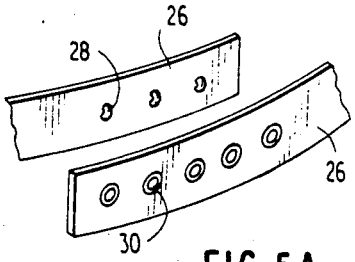
FIG. 5A
FIG. 6
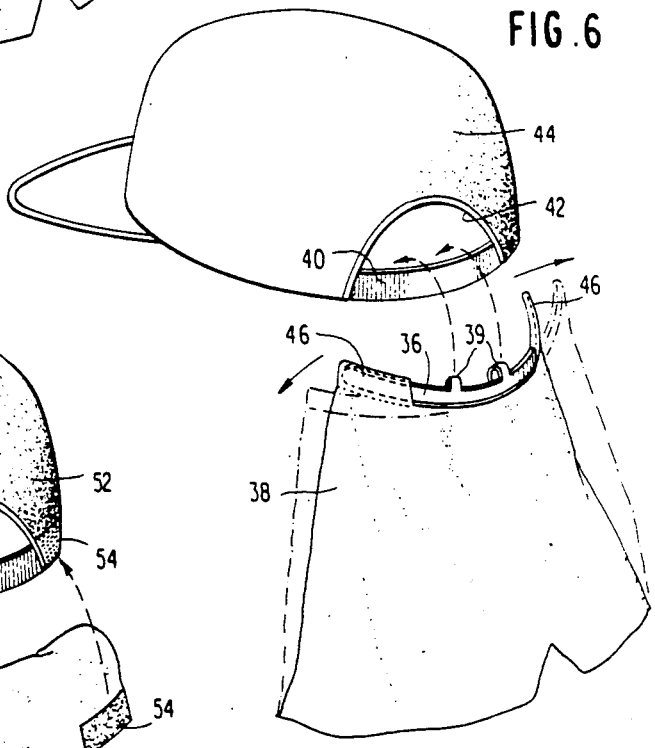
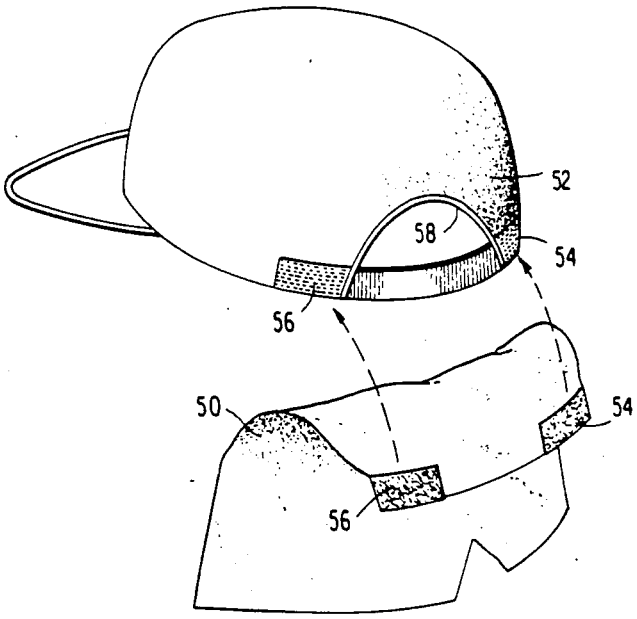
FIG. 7

HEAD BAND WITH NECK SHIELD

This is a continuation of application Ser. No. 07/404,548, filed Sept. 8, 1989, now abandoned.

BACKGROUND OF THE INVENTION

The present invention is directed to a head band having a depending fabric piece detachably or permanently connected thereto and adapted to cover the neck of the wearer to protect the same from sunburn. The head band may completely or partially encircle the head of the wearer and may be used independently or in conjunction with a cap.

The use of havelocks is old and well known in the art. The most familiar use of a havelock is perhaps the well known Foreign Legion hat which has a substantially cylindrical pillbox-shaped configuration with a front visor and a depending rear covering for protecting the neck from sun or bad weather. An example of such a hat with a havelock is shown in U.S. Pat. No. 2,844,822.

While the havelock shown in U.S. Pat. No. 2,844,822 is of integral one piece construction with the hat material, the havelock could be detachably connected to the hat as shown in U.S. Pat. No. 2,897,510.

SUMMARY OF THE INVENTION

The present invention provides a new and improved sunshield for protecting the neck of the wearer wherein the sheet of fabric material constituting the sunshield may be detachably or permanently connected to a head band. The head band may be supported directly on the head or may be used in conjunction with a cap. When the head band is used in conjunction with a cap, the head band can completely encircle the cap in the vicinity of the head band of the cap, or may be a partial head band which is detachably connected to the cap.

The foregoing and other objects, features and advantages of the invention will be apparent from the following, more particular description of preferred embodiments of the invention as illustrated in the accompanying drawings.

BRIEF DESCRIPTION OF THE DRAWINGS

FIG. 1 is a perspective view of a first embodiment of the present invention showing a sunshield and head band as used in conjunction with a cap.

FIG. 2 is an enlarged perspective detail of the rear of the cap showing the location of a fastener for the head band.

FIG. 3 is a perspective view of the sunshield and head band of FIG. 1 without the cap.

FIG. 4 is a perspective view of the sunshield and head band of FIG. 3 as used without a cap.

FIG. 5 is a perspective view of a sunshield and head band according to a second embodiment of the present invention.

FIG. 5A is a partial detailed showing of the connecting means for the head band of FIG. 5.

FIG. 6 is a perspective view of a partial head band and sunshield according to a third embodiment in detached relation with respect to a cap.

FIG. 7 is a perspective view of a sunshield according to a fourth embodiment of the present invention in detached relation to a cap.

DETAILED DESCRIPTION OF THE INVENTION

Figure 8:
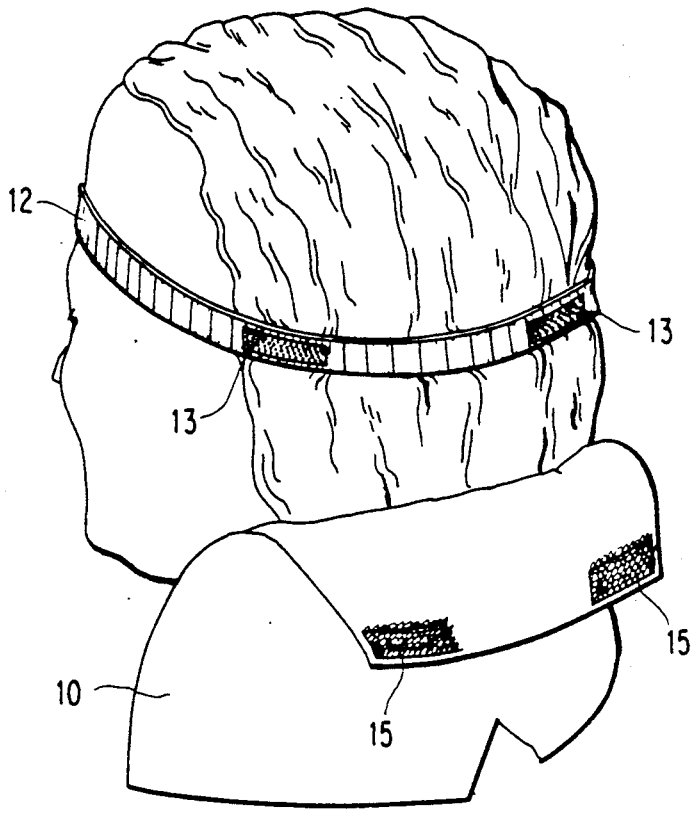
FIG. 8 is a perspective view of a sun shield according to a fifth embodiment in detailed relation to a head band.

The sunshield as shown in FIG. 1 is comprised of a sheet of material 10 of any desired configuration. The sheet of material may be a single sheet secured to a head band 12 as illustrated or may be comprised of a plurality of individual sheets which are secured in adjacent or overlapping relationship to each other. The extent to which the sunshield depends from the head band and the circumferential extent of the sunshield relative to the head band can vary widely within the scope of the present invention. The head band 12 may be of stretchable, elastic, knitted material or any other suitable material which would readily accommodate different sized heads. The head band 12 as shown in FIG. 1 is disposed in superimposed relation with the head band of a cap 14 having a visor 16. The cap may be provided with an inverted U-shaped cut out portion 18 which is spanned by an elastic head band 20 so as to render the cap adjustable for different head sizes. A strip of VELCRO fastening material 22 is secured to the elastic band 20 and cooperates with a complementary VELCRO strip 24 secured to the inside of the head band 12 as shown in FIG. 3. The material of the sunshield flap 10 is shown in FIG. 3 as being folded about the head band 12 and secured thereto by means of stitches. The head band may be endless or have ends secured in the hem of the flap. It is also contemplated within the scope of the present invention to have the sunshield flap 10 detachably connected to the head band 12 by means of separate VELCRO fastening strips 13 and 15 as shown in FIG. 8. Thus, the sunshield flap 10 could readily be secured to conventional knitted sweatbands which are in common use.. The sunshield and head band combination as shown in FIG. 3 can be worn directly on the head of a wearer as shown in FIG. 4 without a cap as shown in FIG. 1.

In a second embodiment as shown in FIG. 5, the head band 26 may be constructed of flexible plastic material with the ends disposed in overlapping relation. The overlapping ends may be adjustably secured by a plurality of protuberances 28 and complementary apertures 30 to accommodate the head band to varying head sizes. The sunshield flap 32 may be provided with a pair of spaced apart, tubular hem portions 34 through which the head band 26 may be removably inserted. Thus, the sunshield flap 32 can readily be mounted on or removed from the head band 26 which in turn may be adjustably sized to fit different head sizes.

In the embodiment of FIG. 6, the head band 36 does not completely encircle the head of the wearer, but only extends the width of the flap 38. The partial head band 36 may be of flexible, semi-rigid plastic material having a pair of hooks 39 integrally formed thereon which are adapted to hook over the conventional head band 40 on a cap in the vicinity of an inverted U-shaped cut out portion 42 of the cap 44. The ends of the partial head band 36 extend into blind, tubular hem portions 46 on the upper edge of the sunshield flap 38. Thus, the head band and sunshield flap combination may be detachably connected to a conventional cap and the sunshield flap 38 may be detachably connected to the head band 36 to facilitate washing of the sunshield.

In the embodiment of FIG. 7, the sunshield flap 50 is not used in conjunction with a head band, but is secured directly to the rear of a cap 52 by means of two pairs of complementary VELCRO fasteners 54 and 56. The VELCRO fasteners 54 and 56 are mounted directly on the cap at opposite sides of the U-shaped opening 58 and on opposite corners of the sunshield flap 50.

The material of the head band, the flap and the cap may vary and various types of fasteners may be used in lieu of VELCRO.

While the invention has been particularly shown and described with reference to preferred embodiments thereof, it will be understood by those in the art that the foregoing and other changes in form and details may be made therein without departing from the spirit and scope of the invention.

What is claimed is:

1. A head band and neck shield combination consisting essentially of an independent annular elastic head bank, a neck shield consisting essentially of a substantially rectilinear sheet of material and fastening means directly and detachably connecting said neck shield to said electric head band.

2. A head band and neck shield combination as set forth in claim 1, wherein said fastening means is comprised of a VELCRO fastener.

* * * * *

UNITED STATES PATENT AND TRADEMARK OFFICE

CERTIFICATE OF CORRECTION

PATENT NO. : 5,046,195

DATED : September 10, 1991

INVENTOR(S) : Gilbert Koritan

It is certified that error appears in the above-identified patent and that said Letters Patent is hereby corrected as shown below:

Column 4, line 3, change "bank" to -- band --;
line 6, change "electric" to -- elastic --.

Signed and Sealed this

Twentieth Day of April, 1993

*Attest:*

MICHAEL K. KIRK

*Attesting Officer*

*Acting Commissioner of Patents and Trademarks*